United States Patent [19]

Willy

[11] 3,979,566

[45] Sept. 7, 1976

[54] ELECTROMAGNETIC TRANSDUCER

[76] Inventor: Erazm Alfred Willy, 1254 Rte. 104, Apt. 1C, Ontario, N.Y. 14519

[22] Filed: Dec. 12, 1973

[21] Appl. No.: 424,001

[52] U.S. Cl. ..... 179/115.5 ES; 179/115.5 VC; 179/120

[51] Int. Cl.[2] ..... H04R 7/18

[58] Field of Search . 179/115.5 ES, 120, 115.5 VC; 310/13, 27

[56] References Cited

UNITED STATES PATENTS

| | | | |
|---|---|---|---|
| 1,895,071 | 1/1933 | Fanger | 179/120 |
| 2,535,757 | 12/1950 | Root | 179/120 |
| 2,540,487 | 2/1951 | Mott | 179/120 |
| 3,328,537 | 6/1967 | Hecht | 179/115.5 ES |
| 3,464,514 | 9/1969 | Mochida et al. | 179/115.5 ES |
| 3,659,124 | 4/1972 | Lathrop | 310/13 |
| 3,660,618 | 5/1972 | White | 179/115.5 R |
| 3,686,446 | 8/1972 | Manger | 179/115.5 DV |
| 3,723,779 | 3/1973 | Gillum | 310/13 |

FOREIGN PATENTS OR APPLICATIONS

| | | | |
|---|---|---|---|
| 301,877 | 10/1931 | Italy | 179/115.5 ES |

*Primary Examiner*—Kathleen H. Claffy
*Assistant Examiner*—C. T. Bartz

[57] ABSTRACT

An electromagnetic transducer wherein magnetic forces are transmitted via an armature that has an elongated regular, or serpentine, tubular shape, and that is positioned within the air gap of a tubular shaped magnetic rim type structure having the same general overall shape as the armature. When used as an electroacoustic transducer, the armature is secured to the peripheral edge of a diaphragm.

41 Claims, 21 Drawing Figures

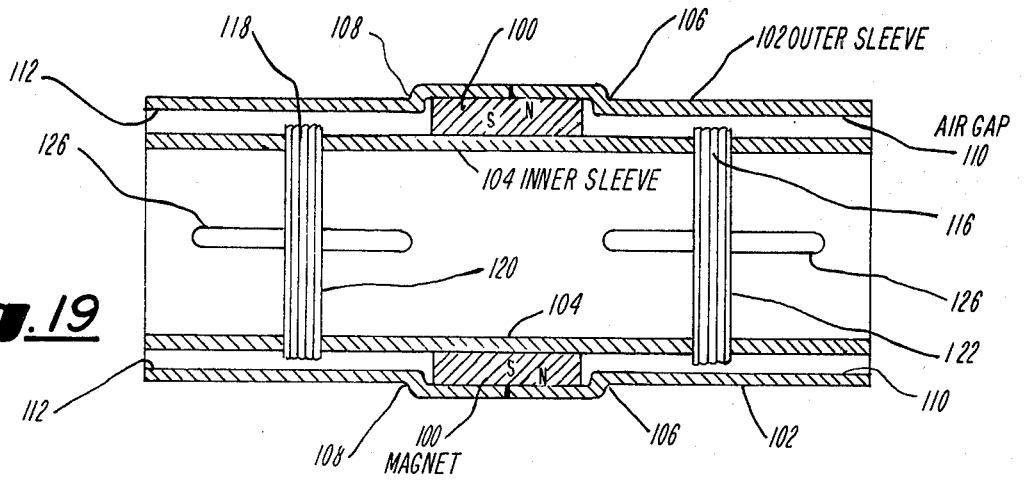
Fig. 19
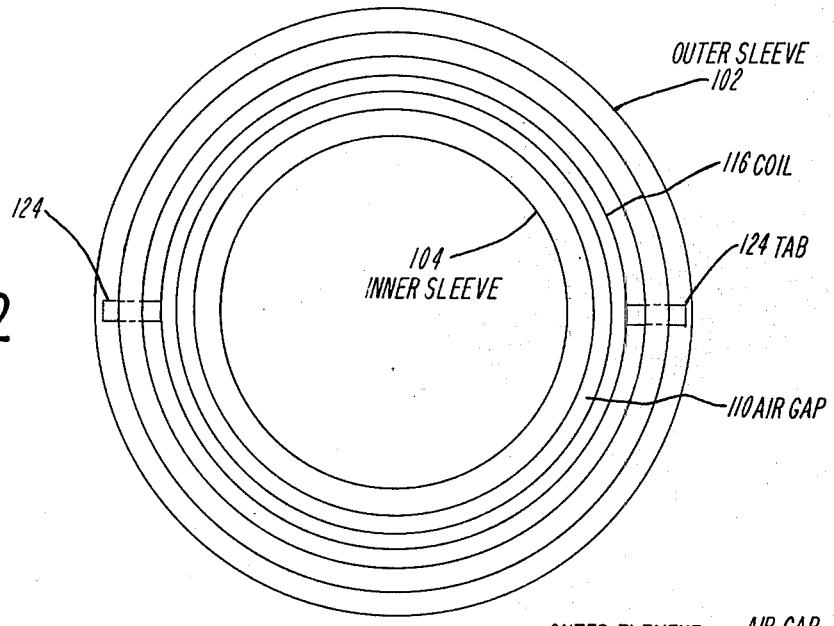
Fig. 20
Fig. 21
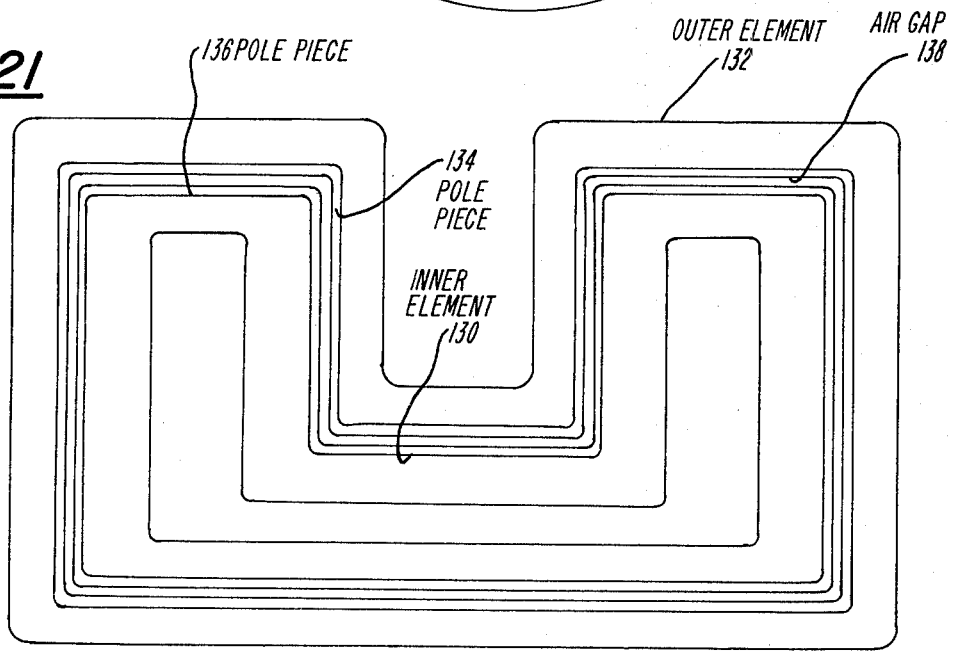

ELECTROMAGNETIC TRANSDUCER

BACKGROUND OF THE INVENTION

This invention pertains, in general, to electromagnetic transducers, and more particularly to transducers for converting electrical energy into movements or sounds, and/or movements or sounds into electrical energy.

Electromagnetic transducers for converting movements or forces (such as sound) into electrical energy, or for converting electrical energy into movements or forces (such as sound), include an electrically conductive moveable element (armature) and a stationary magnetic element (stator) for applying magnetic flux thereto. Forces applied to the armature, as a result of magnetic flux variations, convert electrical energy into movements, and in the case of a speaker, sound. Alternately, physical forces on the armature (such as in the case of microphones) create changes in the magnetic flux and generate electrical signals due to the movement of the armature.

In the prior art speakers, the armature is located in a magnetic field and is generally secured near the center of the diaphragm (speaker cone). The armature usually includes a coil that receives the electrical signals to be converted into sound. The high frequencies are generated at the center of the diaphragm while the intermediate and base frequencies are generated over the entire surface of the cone. Such an arrangement has poor efficiency at high frequencies and as a result usually has a degraded high frequency response. In order to obtain an improved high frequency response, a small "tweeter" type speaker cone has been mounted within the center of the large speaker cone to get greater power output at high frequencies. Other arrangements include separate base and tweeter speakers electrically interconnected with crossover networks to provide an overall high fidelity response. In either case, great care must be taken in the design and manufacture thereof so that the frequency response of the combination provides a continuous transition between high and low frequency ranges, or else certain frequencies will be attenuated, or peaked, resulting in an undesirable frequency response.

The present day speakers use a magnetic structure that is cup shaped, with an inner pole piece extending through the center of the opening. The open edge of the cup forms one magnetic pole while the free end of the inner pole piece forms the other magnetic pole. The air gap between the pole pieces is reduced to increase the concentration of magnetic flux. In order to achieve greater magnetic flux density and higher power output in the high frequency range, the permanent magnets used in the magnetic assembly of the prior art are increased in size so that the speakers are very often rated in "pounds" of magnet (i.e., 2 pound magnet speaker, etc.). This increased size and weight add further structural requirements to the speaker housing so that the speaker will not warp. These requirements add to the cost of the speaker. In addition there is a point of diminishing returns wherein added incremental sizes of magnets will produce diminishing amounts of additional power output at the high frequency range. Furthermore, since it is the strength of the magnetic flux density through the armature that determines the efficiency and the output of the speaker, the size of the magnet (in pounds) may be misleading in cases where poor magnetic flux coupling is provided as a result of poor design.

In order to reduce the size and weight of the magnetic structure of speakers, various peripherially driven transducers were designed, such as for example, those disclosed in the U.S. Pat. Nos. 2,520,646 and 2,535,757 issued on Aug. 29, 1950 and Dec. 26, 1950, respectively, to E. E. Moth and J. J. Root, respectively. These transducers include armature plates secured to the periphery of the diaphragm and a combined permanent magnet and electromagnetic stator arrangement to impart varying magnetic flux to the armature. Such an arrangement provides sufficient power and fidelity for telephone purposes as set forth in U.S. Pat. No. 2,520,646. The arrangement disclosed in U.S. Pat. No. 2,535,757 may have provided sufficient fidelity over 20 years ago, but would probably be considered poor in today's standards. The limited fidelity results from the inherent disadvantages in driving a speaker by modulating the magnetic flux of the stator through the use of a stator coil. The coil required to provide the necessary flux variation introduces a large reactive impedance in the circuit that limits its overall frequency response. It was found that greater efficiency and higher frequency responses would be achieved with the coil mounted on the movable armature as in most present day speakers.

Peripherially driven electroacoustic transducers have been developed wherein the cup shaped magnetic speaker structure of the prior art is used along with a coil attached to the peripheral edge of a diaphragm extending into the air gap. Because of the massive magnetic structure involved (wherein essentially the entire central portion of the cup shaped magnet is formed speaker iron), the arrangement, as a practical matter, is limited in size, for use as a microphone, or as a tweeter speaker. Any increase in size to provide a good base frequency response would be prohibitive because of weight and cost.

Electromagnetic transducers are presently being used in control apparatus, such as a pneumatic controllers (for converting electrical signals, into pressure, or pressure into electrical signals) that employ the same cup shaped magnetic structure as presently used in speakers to drive a ring shaped armature. Because of the weight and size of such a magnetic structure, and the lack of available space, the forces, or electrical signals, produced by such transducers are rather limited. As a result, intricate lever mechanisms must be used with such transducers to provide the desired conversion and hence add to the expense of such apparatus. It would be highly desirable if a transducer could produce the forces, or electrical signals, needed for such control apparatus without requiring the massive and heavy magnetic structure, particularly so if greater forces or higher amplitude electrical signals, could be produced without requiring additional space.

In addition to the foregoing, the electroacoustic transducers of the prior art are highly directional. Most of the acoustic energy generated by the electroacoustic devices is directed in a cone shaped pattern from the center of the diaphragm. If an omidirectional speaker arrangement is desired, a large number of speakers are required to be mounted in some sort of directional array so that the combined effect of all the speakers provides the desired effect. Such an arrangement is quite expensive, requiring many speakers.

It is therefore an object of this invention to provide a new and improved electromagnetic transducer for converting electrical energy into movement, and/or converting movement into electrical energy.

It is also an object of this invention to provide a new and improved electromagnetic transducer that can function as either a speaker, a microphone, or a control device.

It is still a further object of this invention to provide a new and improved electroacoustic transducer that produces increased power output at the high frequency range.

It is also an object of this invention to provide a new and improved electroacoustic transducer that is relatively light weight and can produce a wide range of frequencies, including the high, intermediate and low frequency ranges with a single diaphragm.

It is another object of the present invention to provide a new and improved electroacoustic transducer that is omidirectional in its sound propagation.

BRIEF DESCRIPTION OF THE INVENTION

The transducer of the invention includes an elongated rim shaped magnetic means having poles of opposite magnetic polarity providing an air gap that has the same general elongated configuration as the magnetic means. Current conduction means, such as for example, a coil, having the same general configuration as the air gap, is positioned to extend within the air gap and is responsive to the current flow therethrough to produce movements, or is responsive to a force applied thereto to generate electrical signals.

In the case of an electroacoustic transducer embodying the invention, the current conduction means is secured to a diaphragm adjacent the peripheral edge thereof so that forces are applied to, or received from, the diaphragm periphery.

In accordance with an embodiment of the invention, the magnetic means provides an air gap that has an elongated shape. The air gap can be continuous or discontinuous. The current conduction means has the same elongated shape as the air gap and is mounted to extend within the air gap for movements transverse the flow of magnetic flux. The magnetic means, the air gap, and the current conduction means can have any regular tubular shape such as for example annular, polygon, etc., or can have a serpentine shape.

Since the magnetic means has a tubular rim type shape, it provides a light weight, low cost, means for providing an elongated air gap having high density magnetic flux flowing therethrough. The combination of the elongated air gap and the current conduction means located therein provides for an arrangement wherein the diaphragm is driven at its outer extremities (peripherally), resulting in a substantially larger working area for the generation of high frequencies than with the conventional center driven diaphram and thereby greatly increasing the efficiency of the speaker. Furthermore, since the high frequencies are generated along the peripheral edge of the diaphragm, depending upon the diaphragm shape, the speaker can provide an omi-directional high frequency pattern of sound propagation.

The electromagnetic transducer can be built with the two units back to back for use as a stereo speaker. In addition to the foregoing, the diaphragm can be made of clear plastic, or glass, to provide a transparent center portion.

The electromagnetic transducer can also include two parallel air gaps adjacent each other with the current conduction means (armature) extending into both air gaps for providing further magnetic flux for driving the armature.

Alternately, the electromagnetic transducer can include two air gaps located in tandem with separate current conduction means located in each air gap. With such an arrangement, such current conductions means (armature) can drive separate elements, or can be interconnected in tandem to drive a single element.

BRIEF DESCRIPTION OF THE FIGURES

FIG. 19 is a section view of a sixth embodiment of a electromagnetic transducer, including the invention, having two armatures that can function as a control device.

FIG. 20 is a side view of the electromagnetic transducer of FIG. 19.

FIG. 21 is a plane view of a magnetic structure for a electromagnetic transducer, including the invention, wherein the air gap has a U shaped serpentine configuration.

DETAILED DESCRIPTION OF THE INVENTION

An electromagnetic transducer including the invention has a magnetic structure with an elongated continuous, or discontinuous, air gap. The magnetic structure defines a closed curve (i.e. outlines a closed geometric configuration) and has a hollow rim type shape, such as the annular or tubular shape of a ring, or the straight sided tubular shape of an outline of a polygon, such as a rectangle, a triangle, or a serpentine configuration. The air gap has the same general shape as the magnetic structure.

The electromagnetic transducers of FIGS. 1–18 are described in the context of electroacoustic transducers for converting electrical signals into sounds (speakers) and/or for converting sounds into electrical energy (microphones). In all such cases, the armature is connected to the periphery of a diaphragm to apply forces thereto, or to receive forces therefrom. With a diaphragm as an input or output device, the magnetic structure takes on a regular tubular hollow form (annular, polygon, etc.) to apply, or receive forces, from the periphery of the diaphragm. However, it is to be understood that the electromagnetic transducer of FIGS. 1–18 also can function as a force transducer for use in a variety of control apparatus, wherein the diaphragm is removed and some sort of coupling device, such as for example a lever system, is secured to the armature to provide for the translation of the armature movement. The FIGS. 19–21 are described in the context of specialized control system transducers wherein diaphragms are not required and the magnetic structure and air gap can take more the complex serpentine tubular forms. By tubular shaped we means any rim shape structure wherein an empty or hollow space is encompassed or surrounded by the rim shaped structure.

Figure 4:
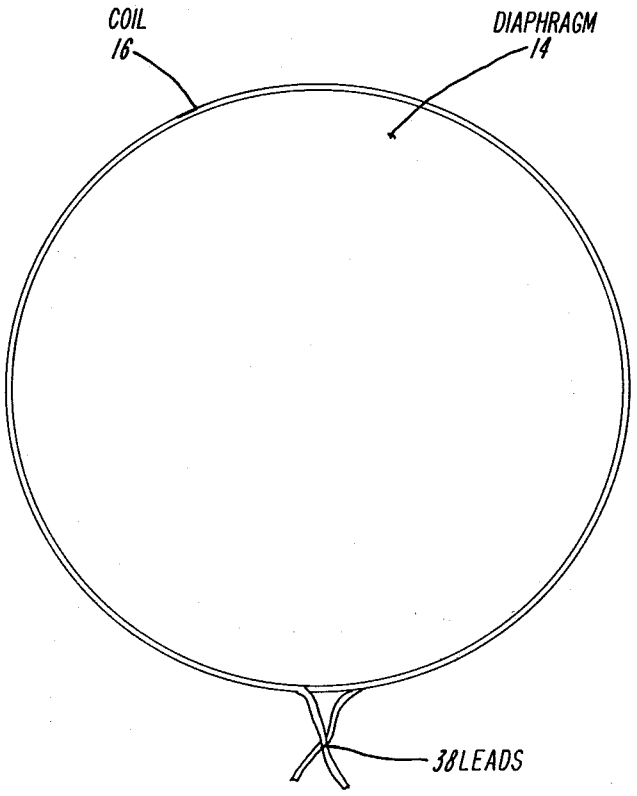
FIG. 4 is a front view of the diaphragm of FIG. 3.
Figure 1:
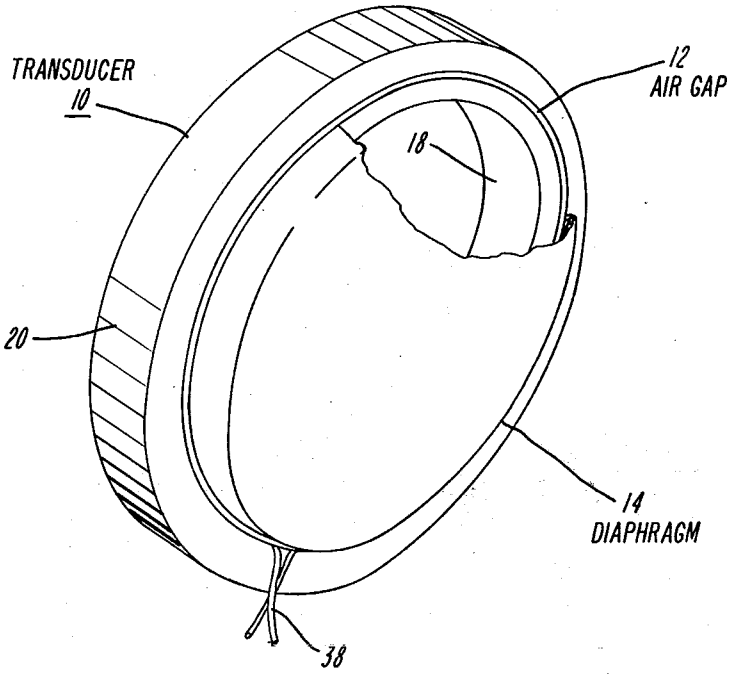
FIG. 1 is a persepctive view of an embodiment of an electromagnetic transducer, including the invention, having a round, or disc shaped configuration.
Figure 3:
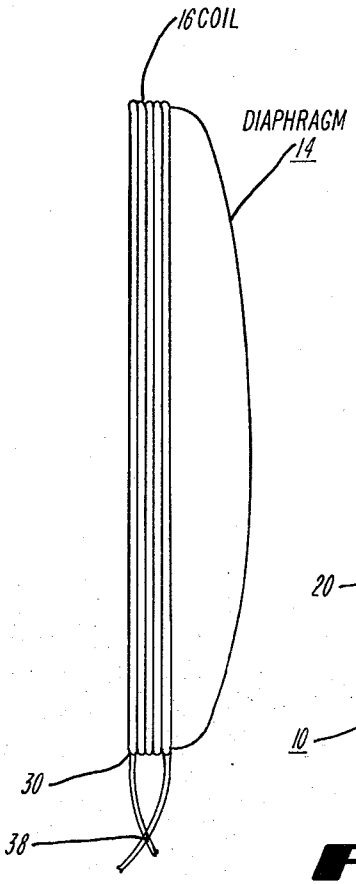
FIG. 3 is a side view of the diaphragm of the electromagnetic transducer of FIG. 1.
Figure 2:
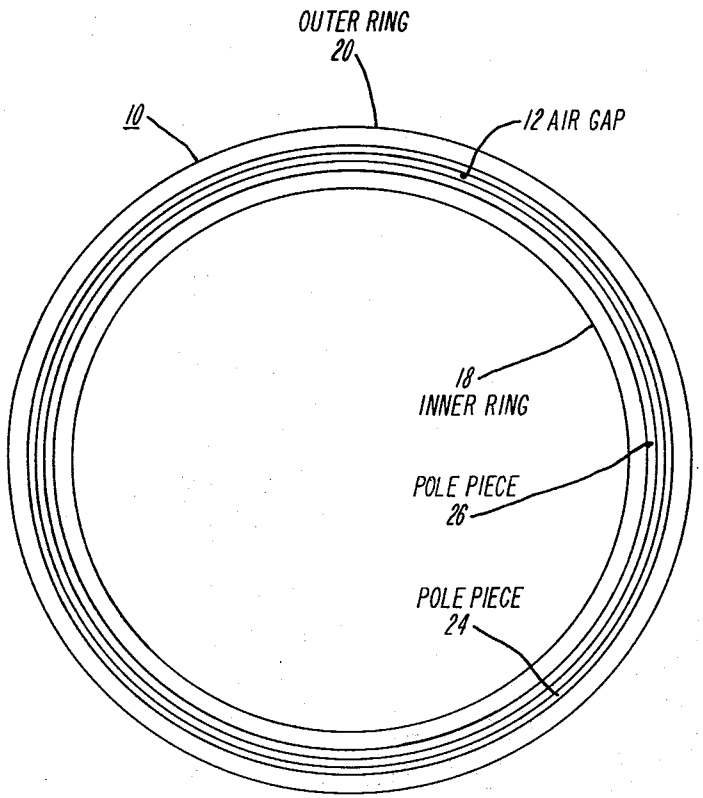
FIG. 2 is a front view of the electromagnetic transducer of FIG. 1 with the diaphragm removed.

The embodiment of the electroacoustic transducer illustrated in FIGS. 1–11 includes an annular or tubular shaped housing 10, having a magnetic structure that provides a tubular ring shaped air gap 12. The air gap 12 provides the magnetic flux for producing the transducer action. A diaphragm 14, having the general form of the geometric configuration enclosed by the air gap 12, is mounted with the peripheral edge 30 thereof extending within the air gap 12. The diaphragm 14 has the general form of a disk, with a slight convex shape, and with the peripheral edge 30 thereof folded over to extend transverse (generally normal) to the plain of the diaphragm 14 and into the air gap 12. The edge 30 of the diaphragm 14 follows the same general ring shape as that of the air gap 12. Current conduction means, such as a coil 16, is attached to the diaphragm 14 adjacent to the peripheral edge 30 (as illustrated in FIGS. 3 and 4) so that when the edge 30 of the diaphragm 14 is positioned in the air gap 12, the current conduction means also extends within the air gap. The current conduction means or coil 16 is wound in the form of a ring, the same general tubular shape configuration as the air gap 12.

Figure 6:
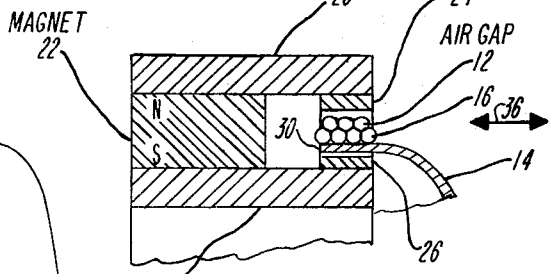
FIG. 6 is a sectional view of the electromagnetic transducer of FIG. 1 taken along the lines 6—6.
Figure 8:
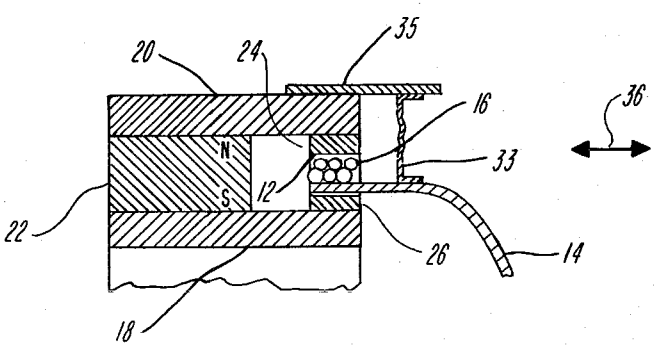
FIG. 8 is a sectional view of a portion of the electromagnetic transducer of FIG. 1 taken along the lines 8—8 and using a flexible ring for maintaining the diaphragm within the air gap.
Figure 9:
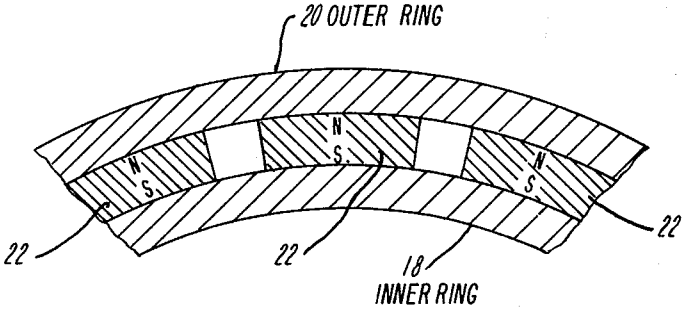
FIG. 9 is a sectional view of the electromagnetic transducer of FIG. 1 taken along lines 9—9 of FIG. 5.
Figure 10:
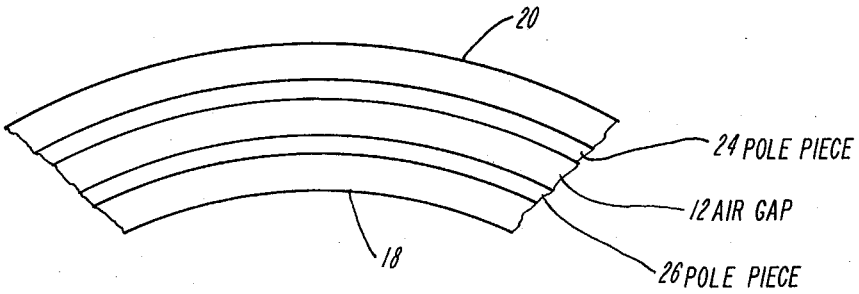
FIG. 10 is a sectional view of the electromagnetic transducer of FIG. 1 taken along lines 10—10 of FIG. 5, with the diaphragm removed.

The housing 10 of the electroacoustic transducer is formed with an innner metallic annular shaped element or ring 18, and an outer annular shaped element or ring 20. Magnetic means 22 is mounted between the inner and outer rings 18 and 20, with the opposite poles thereof positioned adjacent to the inner and outer rings 18 and 20 as illustrated in FIGS. 6, 8 and 9. The magnetic means 22 can be a solid continuous annular or ring type ceramic, or rare earth magnet, or can comprise of a plurality ceramic magnets mounted adjacent to each other as (illustrated in FIG. 9) to provide the overall effect of a continuous annular shaped magnet. The width of the magnets 22, as viewed in FIGS. 6 and 8 is less than the width of the rings 18 and 20. The magnets 22 are mounted adjacent an end of the rings 18 and 20, opposite the end that extends toward the diaphragm 14. A pair of annular or ring shaped pole pieces 24 and 26 are mounted adjacent the end of the inner and outer rings 18 and 20, opposite the end adjacent the magnets 22. The air space between the pole pieces 24 and 26 defines the annular or ring shaped air gap 12 through which magnetic flux flows. Since the two rings 18 and 20 cover the entire ends of the magnets 22, substantially all of the magnetic flux from the magnets flows through the easy flux path (the path of low impedance) which extends from the magnets through a ring, through a pole piece, through the air gap, through the other pole piece, and back through the other ring to the magnets. The effect of the two rings 18 and 20 and the two annular pole pieces 24 and 26 is to concentrate substantially all of the magnetic flux from the magnets 22 across the air gap 12. The magnetic flux radiating from the large crossectional area of the magnets 22 is concentrated into a much smaller crossectional area of the air gap 12 thereby providing an extremely concentrated magnetic flux in the air gap.

Figure 11:
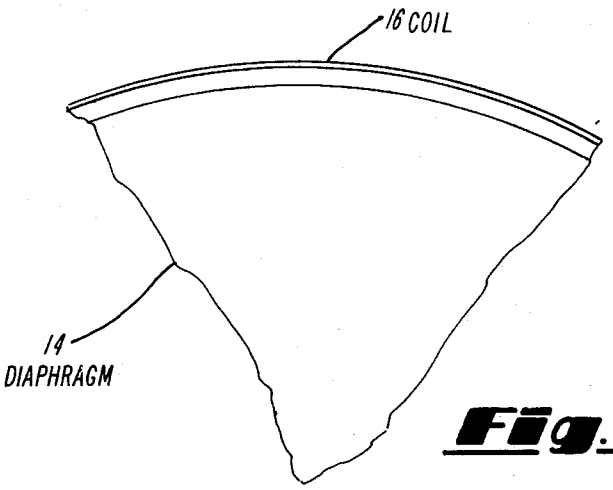
FIG. 11 is an enlarged view of a portion of the diaphragm of the electromagnetic transducer of FIG. 1 taken along lines 11—11 of FIG. 3.

As illustrated in FIGS. 3, 4 and 11, the current conduction means, or coil 16, is wound around the peripheral edge 30 of the diaphragm 14 in a direction parallel to the edge. The coil 16 is fastened by cement to the diaphragm 14 adjacent the edge 30. As previously mentioned, the folded end 30 of the diaphragm 14 and the coil 16 have substantially the same annular shaped configuration as the air gap 12, so that the diaphragm end 30, and the coil 16 mounted thereon, are inserted into the air gap 12. The coil 16 and the end 30 of the diaphragm 14 are loosely mounted in the air gap 12 for free movement back and forth in a direction transverse the flow of magnetic flux, as illustrated by the arrows 36.

Figure 7:
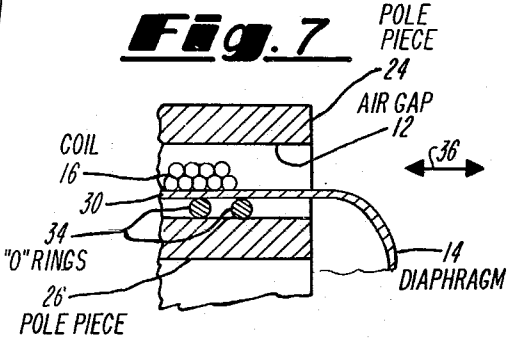
FIG. 7 is a sectional view of the air gap portion of the electromagnetic transducer of FIG. 1 including a pair of O rings for maintaining the diaphragm within the air gap.
Figure 5:
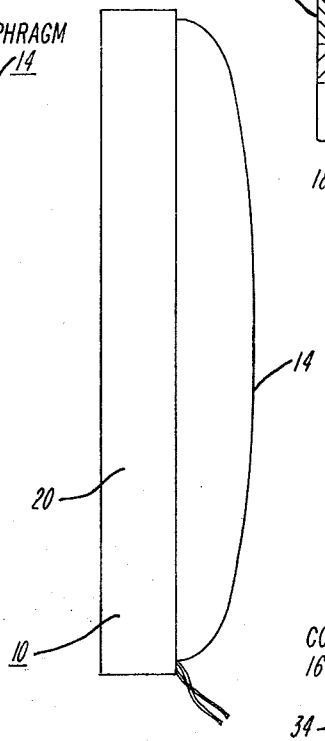
FIG. 5 is a side view of the electromagnetic transducer of FIG. 1.

The diaphragm 14 and the coil 16 can be held in place in the air gap 12 by the use of a fleixble rubber cement. Alternatively, the coil 16 and the diaphragm 14 can be held in place by a pair of O rings 34 as illustrated in FIG. 7. The O rings 34 have a cross sectional diameter in the order of one half the diameter of the air gap 12 and extend around the entire length thereof. The O rings 34 have a thickness so that when the coil 16 and the diaphragm end are placed thereon, a loose fit is accomplished so that the coil 16 and the diaphragm 14 are free to move back and forth transverse the magnetic field. Another method of maintaining the coil 16 and the end of the diaphragm 14 within the air gap 12 is illustrated in FIG. 8. A plastic ring 35 is attached to the outer annual member 20 to extend beyond the end thereof. A very thin nylon cloth ring 33 is attached at one end to the plastic ring 35 and at the other end to the diaphragm 14.

In response to a force applied to the diaphragm 14 an electrical signal is generated across the coil leads 38 wherein the electroacoustic transducer functions as a pickup device, such as a microphone. Alternatively, in response to a current flow through the coil 16 the diaphragm 14 is forced to move along the direction of the arrows 36 to function as a receiver, or as a speaker. The movement of a coil within a magnetic flux as a result of a physical force applied thereto for producing electricity, or the movement of a coil with a magnetic flux in response to a current flow therethrough for producing sound, are well known phenomenon and do not require any further explanation. Hence, as can be seen in the electromagnetic transducer of the invention, the electromotive force is applied along the peripheral edge of the diaphragm 14 thereby providing a large working area for the translation of forces to and from the diaphragm 14.

Figure 12:
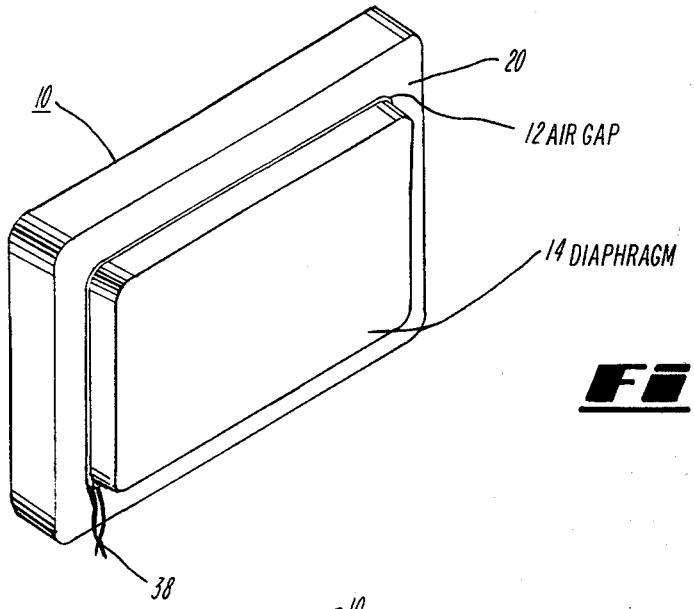
FIG. 12 is a perspectivew view of a second embodiment of a electromagnetic transducer, including the invention, having a generally rectangular shape.
Figure 13:
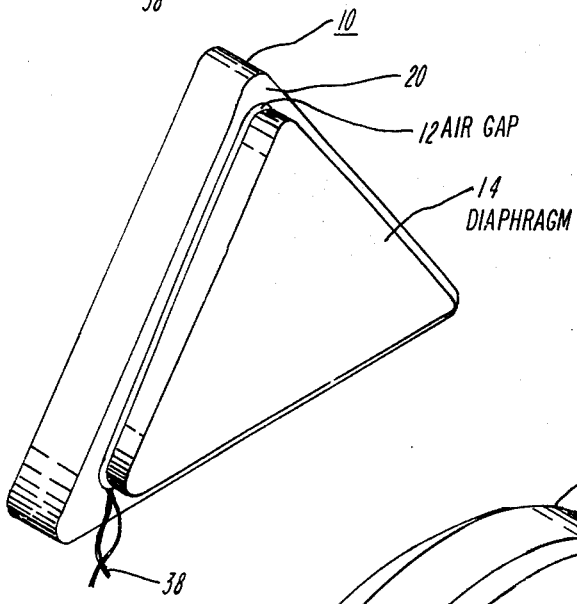
FIG. 13 is a perspective view of a third embodiment of a electromagnetic transducer, including the invention, having a generally triangular shape.

It should be understood, that the electromagnetic transducer of the invention can have any type of overall configuration. For example, the air gap 12 can have the tubular form of a polygon rather than the ring shape, such as the rectangular tubular configuration illustrated in FIG. 12, or the triangular tubular configuration illustrated in FIG. 13. For the purposes of simplifying the explanation of the electromagnetic transducers of FIGS. 12 and 13, the same elements in FIGS. 12 and 13 as in FIGS. 1–11 are designated by the same reference numerals, although, the configuration, or shape, of the elements differ. As illustrated in FIGS. 12 and 13, the inner and outer metallic elements, and the magnetic means mounted therebetween (not shown), define an air gap 12 having the tubular configuration of the outline of a polygon (such as the rectangle of FIG. 12 or the triangle of FIG. 13). In each of the embodiments of FIGS. 12 and 13, the peripheral edge of the diaphragm 14 is bent to form an angle transverse to the plain of the diaphragm 14 and has the same general shape, or configuration, as the air gap 12 (rectangle, triangle, etc.). In addition, the current conduction means, or coil 16, (not shown) is attached adjacent to the peripheral edge of the diaphragm 14 and extends within the air gap 12 (in a manner as previously discussed with regards to FIGS. 1–11). As in the case of the transducer of FIGS. 1–11, the diaphragm 14 of FIGS. 12 and 13, and the current conduction means attached thereto, are free to move back and forth within the air gap 12 in a direction transverse to the flow of magnetic flux, in the same manner as discussed above, and therefore is free to function as either a microphone, or as a speaker.

Figure 14:
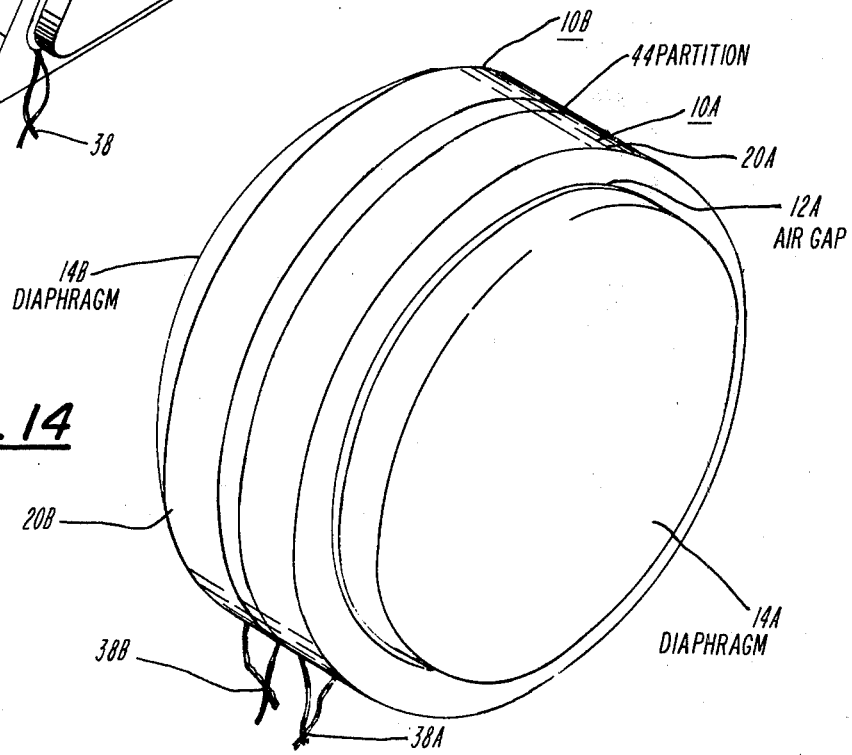
FIG. 14 a is a fourth embodiment of a electromagnetic transducer, including the invention, including two transducers back to back for stereo operation.

FIG. 14 illustrates two electromagnetic transducers, of the type illustrated in FIGS. 1–11, positioned back to back, to provide a double speaker configuration for producing a stereo effect. When the two electromagnetic transducers 10A and 10B are mounted adjacent to each other as illustrated in FIG. 12, a partition 44 is positioned between the two transducers (along the side opposite that having the diaphragms 14A and 14B) to prevent the interference of sound wave therebetween. If a more prominent stereo effect is desired, the transducers 10A and 10B can be separated from each other depending upon the distance between the listener and the transducers.

The air gap 12 of FIGS. 1–15 is illustrated as having the shape of a continuous closed curve. If for some reason the continuous air gap is not desired, such as for example because of the use of very thin rings 18 and 20 for cost reduction or weight reduction purposes, the air gap 12 can be broken into a plurality of sectors by the non-metallic (plastic) separators 40 to strengthen the structure (as illustrated in FIG. 16). In this case, the diaphragm 14 is fitted with grooves or slots 42, one for each of the separators 40 (FIG. 17) so that the peripheral edge of the diaphragm 14 has the same configuration as the air gap and fits within the air gap. The coil 16 is wound around the peripheral edge 30 with portions thereof bent to by-pass the slots 42. It should be undertood that the size of the separators 40 can be increased in size substantially over that illustrated in FIG. 16 to provide a plurality of separate air gaps and the electromagnetic transducer will still function, but less effectively.

If for some reason a plurality of coils are desirable instead of a single coil, a plurality of coils 16A, 16B etc., (FIG. 18) can be located along the peripheral edge 30 in an arrangement so that when the diaphragm 14 is located within the air gap 12 only one half the coils 16A and 16B (separated by the dashed line 46) extend within the air gap.

Figure 15:
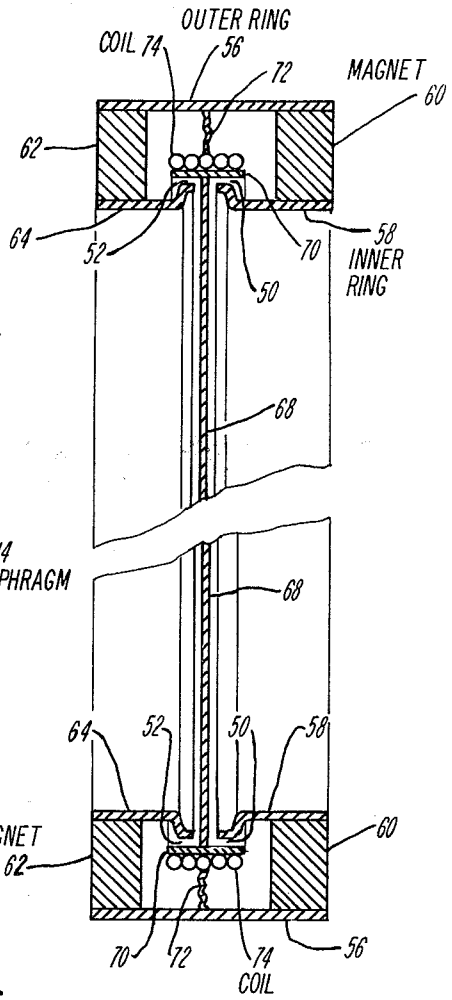
FIG. 15 is a sectional view of a fifth embodiment of electromagnetic transducer, including the invention, wherein the armature extends within two air gaps.
Figure 18:
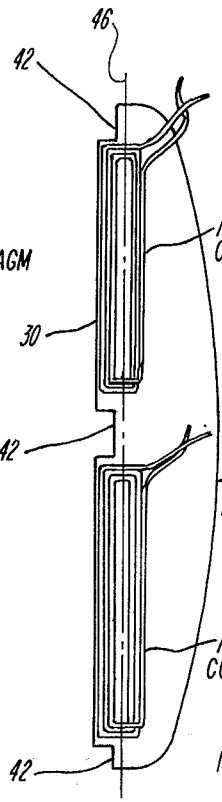
FIG. 18 is a modification of the diaphragm of FIG. 17 having a plurality of separate coils secured to the peripheral edge of the diaphragm.
Figure 17:
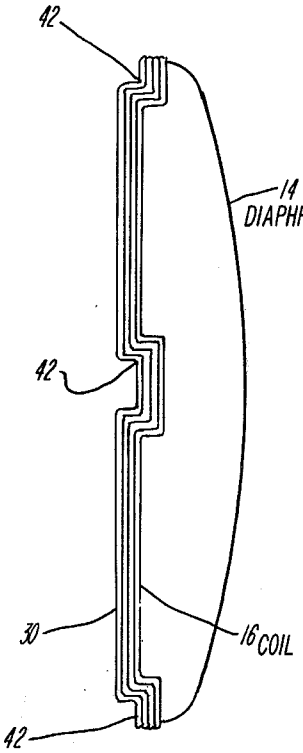
FIG. 17 is a side view of a diaphragm for the electromagnetic transducer of FIG. 16 having segments removed from the edge thereof to fit within the sectorized air gap and having a continuous coil wound around the edge thereof.
Figure 16:
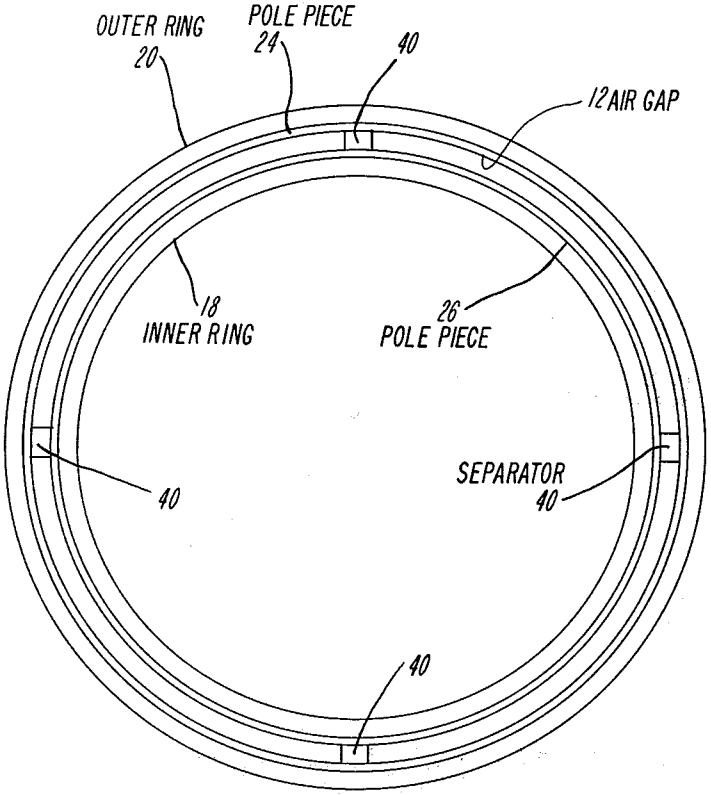
FIG. 16 is a front view of the annular shaped electromagnetic transducer of FIG. 1 with the diaphragm removed and with the air gap separated into sections.

In the embodiment of the electromagnetic transducer of the invention of FIG. 15, rather than having the air gap extending outward as illustrated in FIGS. 1–14 and 16–20, the transducer of FIG. 15 includes two air gaps 50 and 52, both extending inward. The air gap 50 is part of the magnetic flux path for the shaped magnet 60, the annular metallic ring 56 and the annular pole pieces 60, the annular metallic ring 56 and the annular pole piece 58. The air gap 52 is part of the magnetic flux path for the magnet 62, the ring 56 and the annular pole piece 64. The pole pieces 58 and 64 are bent inward at the free ends to extend toward the ring 56 to reduce the size of the air gaps 50 and 52. A flat planar disc shaped diaphragm 68 is fastened along its peripheral edge to an insulating ring 70. The insulating ring 70 is fastened to the metallic ring 56 by a thin nylon cloth ring 72. A coil 74 is wound around the insulating ring 70 in a manner so that the coil 74 extends into both of the air gaps 50 and 52. The direction of the magnetic fluxx through the air gaps 50 and 52 is of a polarity, and the coil 74 is wound so that the current flow in the coil produces an additive force in the air gaps 50 and 52 to move the coil and the diaphragm 14 in the direction of the arrows 76. Although the transducers of FIG. 15 is described as being annular or ring shaped, it is to be understood that the transducer can have any tubular type form, such as polygon shapes (triangular, rectangular, etc.).

A tubular shaped, hollow, magnetic structure providing an elongated air gap 12 (in the form of the closed curve, or in sections of a closed curve) in combination with the diaphragm 14 (having the edge thereof, of the same shape as the air gap 12) including a coil along its peripheral edge (formed to fit within the air gap 12) provides an arrangement wherein electromotive forces are transmitted between the pole pieces 24 and 26 and the diaphragm 14 over the entire, or portions of, the peripheral edge of the diaphragm. The combination of the peripheral edge of the diaphram and the coil attached thereto provides a large working area, wherein the entire, or a large part of the peripheral edge 30 is exposed to the electromotive forces. This provides a highly efficient arrangement, particularly at the high frequency range. In the case wherein the transducer of the invention functions as a speaker, the high frequency signals are generated along the entire circumference or peripheral edge of the diaphragm 14 thereby providing a substantially greater transducing area for the generation of high frequencies. As a result, the single diaphragm 14, in a electroacoustic transducer including the invention, provides a wide range of frequencies wherein the effective power output at the high frequency range approaches that of the lower frequency ranges. There is no need for "tweeter" speakers to accentuate the high frequencies. The entire broad range of audio frequencies are generated by the single diaphragm 14. In addition to the foregoing, it should be noted that since the high frequencies are generated at the circumference or peripheral edge 30 of the diaphragm 14, the propagation of the high frequency signals appears to be in all directions essentially providing the effect of a omni-directional speaker. This is because the direction of music and sound is primarily detected by the human ear from the propagation of the high frequency sounds. The propagation pattern of the high frequencies from the electroacoustic transducer including the invention approaches a pattern of 360° and therefor it is very difficult for the listener to detect the source of the sound.

In addition to the foregoing, the diaphragm 14 of the electroacoustic transducer including the invention can be made of a variety of thin, fairly rigid materials, such as for example, clear plastic or glass. With a clear plastic or glass diaphragm, the electroacoustic transducer appears as a hollow ring, or polygon shaped tube, with a clear "see through" center. Hence, a various novelty items can be included within the speaker, such as for example, lighting or color effects wherein the intensity of, and a frequency of, illumination and color the thereof is a function of the amplitude and frequency of the sound being produces (psychedelic effects). Furthermore, the embodiment of the transducer of FIG. 12 has the added advantage wherein the rectangular diaphragm 14 and the elements forming the air gap 12 can be built about the front of a television tube with the clear diaphragm 14 positioned across the face television tube. Such an arrangement provides a "see through" speaker for viewing the television screen wherein the diaphragm functions as the source of sound and a very large speaker, having extremely excellent acoustical fidelity, for television sets requiring very little extra space.

The embodiment of electromagnetic transducer illustrated in FIGS. 19 and 20 is described in the context of a transducer for use in control systems, such as for example, lens focusing, or a pneumatic controller. The transducer includes an annular tubular shaped magnet 100 (of the type specified above) providing the magnetic flux for the transducer. The magnet 100 is secured between an outer metallic sleeve 102 and an inner metallic sleeve 104, both of which extend beyond opposite ends of the magnet 100. The outer sleeve 102 includes the bends 106 and 108 so that the portion of the sleeve 102 and 104 that extend beyond the magnet 100 are brought in close proximity to define two annular tubular shaped air gaps 110 and 112. The dimensions of the air gaps 110 and 112 extending along the direction of the axis 114 of the transducer and are substantially longer than the corresponding dimensions of the transducer of FIGS. 1–18 since it is movement, rather than sound, to be the input or output signal.

Separate current conduction means (armatures 116 and 118) are positioned in separate ones of the air gaps and are mounted on the rings 120 and 122. The rings 120 and 122 include a plurality of tabs 124 which extend into the guideways 126 to provide bearing surfaces for the armatures. The item to be controlled is secured to the rings 120 and 122. For example, the coils 116 and 118 can be driven by a differential amplifier to provide a corresponding differential movement from the coils. Alternatively, the coils 116 and 118 can be driven in parallel and the coils connected to a lever mechanism in an aiding tandem management. If the transducer is to be used in an optical system, the lens, or lenses can be secured to the rings 120 and 122. The armatures can be coupled to drive a single lens or can drive separate lenses. In addition, similar transducers of the type illustrated in FIG. 19 and 20 can be stacked in a tandem arrangement, so that the transducer can provide a variety of functions in response to a large combination of input signals.

Although the transducer of FIGS. 19 and 20 is illustrated as having an annular tubular shape, it is to be understood that it can have a variety of tubular shapes, such as triangular, rectangular, oval, etc., depending upon the specific design requirements.

At times, the space provides for a control transducer may be limited and weight may be a problem. Th air gap of the transducer of the invention can be increased by providing a serpentine type of configuration, such as the U shaped configuration of FIG. 21 wherein the elongated length of the air gap is increased over that provided by the regular tubular shaped configurations of FIGS. 1–20. As illustrated in FIGS. 21, the transducer includes an inner U shaped metallic element 130 and an outer U shaped metallic element 132 having a U shaped magnet structure (not shown) disposed therebetween. A pair of U shaped pole pieces 134 and 136 extend toward each other from the elements 130 and 132 to define a continuous U shaped air gap 138 defining a closed curve. The armature for the transducer of FIG. 21 will also have a U shape to conform with the air gap 138. As can be seen, since the length of the air gap 138 is greater than that provided by a tubular configurations of that of FIGS. 1–20, a greater working area is provided and therefore a greater output verses space is achieved by this arrangement. It should be understood with the transducer of the invention, any type of serpentine closed curve air gap configuration can be provided, depending upon the design requirements and the space available.

I claim:

1. An electroacoustic transducer comprising:

a diaphragm;

tubular shaped current conduction means secured to said diaphragm along a peripheral edge thereof;

concentric tubular shaped open ended magnetic flux translative elements providing at least one tubular shaped air gap therebetween for receiving said current conduction means, and permanent magnet means mounted between said elements so that said elements concentric magnetic flux from said permanent magnet means through said air gap.

2. An electroacoustic transducer as defined in claim 1 wherein:

said current conduction means has substantially the same shape as said air gap and extends within said air gap for movement transverse the flow of magnetic flux.

3. An electroacoustic transducer as defined in claim 2 wherein:

said diaphragm encloses at least the area enclosed by said current conduction means.

4. An electroacoustic transducer as defined in claim 2 wherein:

said concentric elements have an annular tubular shape.

5. An electroacoustic transducer as defined in claim 2 wherein:

said concentric elements have the tubular shape of a polygon.

6. An electroacoustic transducer as defined in claim 3 wherein:

said current conduction means comprises a coil.

7. An electroacoustic transducer as defined in claim 3 wherein:

said current conduction means comprises a plurality of coils secured adjacent the peripheral edge of the diaphragm so that only one half of each coil extends within the air gap.

8. A transducer comprising:

a pair of tubular shaped magnetic flux translative elements mounted in a substantially concentric arrangement for providing therebetween at least one tubular shaped air gap, one of said pair of elements being open at both ends while the other one of said pair of elements being open at at least one end, and permanent magnet means mounted between said pair of elements for providing magnetic flux flow through said elements and said air gap;

current conduction means having a shape to fit within said air gap, and means for mounting said current conduction means so that at least a portion thereof extends within said air gap so that in response to a current flow through said current conduction means said current conduction means moves within said air gap.

9. A transducer as defined in claim 8 wherein:

said pair of elements, said air gap, and said current conduction means have an annular tubular shape.

10. A transducer as defined in claim 8 wherein:

said pair of elements, said air gap, and said current conduction means have a polygon tubular shape.

11. An electroacoustic transducer comprising:

a stator including a pair of tubular shaped magnetic flux translative elements in concentric relation for providing at least one air gap therebetween having an elongated shape defining a closed curve and following the shape of the pair of elements, one of said pair of elements being open at both ends while the other one of said pair of elements being open at at least one end, and permanent magnet means mounted between said elements for providing magnetic flux flow through said elements and said air gap;

current conduction means having substantially the same shape as said air gap extending within said air gap;

diaphragm means, and means for securing said diaphragm means to said current conduction means adjacent the peripheral edge of said diaphragm means.

12. An electroacoustic transducer as defined in claim 11 wherein:

said diaphragm covers at least the geometric area enclosed by said current conduction means.

13. An electroacoustic transducer comprising:

a stator, including a pair of tubular shaped magnetic flux translative elements arranged in a substantially concentric relation providing at least one air gap therebetween having an elongated configuration defining a closed curve substantially following the tubular shape of said pair of elements, one of said pair of elements being open at both ends while the other one of said pair of elements being open at at least one end, and permanent magnet means mounted between said elements with poles of opposite polarity facing separate elements providing magnetic flux flow through a path including said pair of elements and said air gap;

current conduction means having substantially the same configuration as said elongated air gap and positioned therein for movement, in response to current flow therethrough in a direction transverse the flow of magnetic flux through said air gap, and diaphragm means connected to said current conduction means adjacent the peripheral edge of the diaphragm means and having substantially the same shape of the area defined by the shape of said current conduction means.

14. An electroacoustic transducer as defined in claim 13 wherein:

said current conduction means is a coil, the winding thereof wound to extend in substantially the same direction as the elongated configuration of said air gap.

15. An electroacoustic transducer as defined in claim 13 wherein:

said current conduction means comprises a plurality of coils secured adjacent the peripheral edge of the diaphragm means so that only one half of each coil extends within the air gap.

16. An electroacoustic transducer as defined in claim 15 wherein:

the shape of the air gap is multisided and defines angles of 360° enclosed therein.

17. An electroacoustic transducer as defined in claim 14 wherein:

said elements, and said air gap, have the annular shape of a ring.

18. An electroacoustic transducer as defined in claim 14 wherein:

said elements, and said air gap, have the shape of a polygon type tube.

19. An electroacoustic transducer as defined in claim 14 wherein:

said elements, and said air gap, have the shape of a rectangular tube.

20. An electroacoustic transducer as defined in claim 14 wherein:

said elements, and said air gap, have the shape of a triangular tube.

21. An electroacoustic transducer comprising:

a first metallic element having an open ended tubular shape;

a second metallic element, having substantially the same tubular shape as said first element but having smaller dimensions so that the second element is positioned in a substantially concentric relation within said first element;

permanent magnet means mounted between the first and second elements and adjacent one end of each of said elements so that the other end of each of said first and second elements define an air gap therebetween and wherein magnetic flux flows from said permanent magnet means through a path including said elements and said air gap;

current conduction means, having substantially the same configuration as said air gap, mounted for movement within said air gap, and diaphragm means, having substantially the same geometric configuration as the area enclosed by said current conduction means, extending across said current conduction means and attached thereto.

22. An electroacoustic transducer as defined in claim 21 wherein:

said diaphragm means has the shape of a disc.

23. An electroacoustic transducer as defined in claim 21 wherein:

said first and second elements, said air gap, and said current conduction means, have the shape of a polygon shaped tube.

24. An electroacoustic transducer as defined in claim 23 wherein:

said first and second elements, said air gap, and said current conduction means, have a substantially triangular tubular shape.

25. An electroacoustic transducer as defined in claim 23 wherein:

said first and second elements, said air gap, and said current conduction means, have a substantially rectangular tubular shape.

26. An electroacoustic transducer comprising:

a stator including a plurality of tubular shaped open ended magnetic flux translative elements positioned in a substantially concentric relation for providing two separate air gaps that have substantially the same tubular shape as said elements and are located adjacent and parallel to each other with a separation in between, and permanent magnet means mounted between said elements to provide magnetic flux flow through said elements and said air gaps;

current conduction means, having substantially the same configuration as said air gaps;

means for mounting said current conduction means so that said current conduction means extends within both air gaps for free movement, in response to a current flow therethrough, in a direction transverse the direction of magnetic flux flow through said air gaps, and diaphragm means connected to said current conduction means adjacent the peripheral edge of the diaphragm means enclosing at least the area defined by the shape of the current conduction means and extending through said separation between said air gaps.

27. An electroacoustic transducer comprising:

a stator including a pair of concentric tubular shaped magnetic flux translative elements defining an air gap in between having substantially the same tubular shape as said elements, one of said elements being open at both ends while the other one of said pair of elements being open at at least one end, a plurality of separators dividing said air gap into a plurality of separate air gap sections, and permanent magnet means mounted between said elements for providing magnetic flux flow through a path including said elements and said air gap, and current conduction means having substantially the same configuration as said air gap with portions thereof extending into said plurality of air gap sections, said current conduction means being responsive to the flow of current therethrough to create forces on the current conduction means to move the current conduction means in a direction transverse the magnetic flux lines in the air gap sections.

28. An electromagnetic transducer as defined in claim 27 including:

a diaphragm, having the configuration of the area enclosed by said air gap, attached to said current conduction means so that the transducer functions as an electroacoustic transducer.

29. An electromagnetic transducer as defined in claim 27 wherein:

said current conduction means includes a continuous coil wound in a direction following said air gap with portions thereof bent to avoid the separators in between the air gap.

30. An electroacoustic transducer as defined in claim 27 wherein:

said current conduction means includes a plurality of coils, a separate one for each of the plurality of air gaps, said coils being positioned within the associated air gaps so that the windings of one-half said coils extend within the air gaps.

31. An electroacoustic transducer comprising:

tubular shaped permanent magnet means having exterior and interior magnetic poles of opposite magnetic polarity;

a first pole piece, having a tubular shape, surrounding the exterior of the magnet means and extending beyond the magnet means along the axial tubular direction of the magnet means, a second pole piece, having a tubular shape, abutting the interior of the magnet means and extending in the same direction as said first pole piece to define a tubular shaped air gap therebetween, the arrangement being such that magnetic flux from said permanent magnet means flows through a path including said first and second pole pieces and said air gap, and current conduction means having substantially the same tubular shape as said air gap and positioned therein so that in response to a current flow therethrough a force is created to move the current conduction means along said air gap.

32. An electromagnetic transducer as defined in claim 31 wherein:

said first and second pole pieces extend beyond the permanent magnet means, along the axial tubular direction, and on both sides of the permanent magnet means to provide two separate tubular shaped air gaps, and said current conduction means, includes two units each having substantially the same shape as said air gaps and positioned in separate ones of the air gaps.

33. An electromagnetic transducer as defined in claim 31, including:

guide means for said current conduction means for controlling the linear movement of said current conduction means in said air gap.

34. An electromagnetic transducer comprising:

stator means including first and second open ended tubular shaped magnetic flux translative elements, the second element having smaller dimensions than the first so that the second element is positioned in a substantially concentric relation within said first element to form a hollow structure, said first and second elements being shaped so that a first end of each of the first and second elements is spaced further apart than a second end of each of said first and second elements, wherein the spacing between said second ends define a air gap, and permanent magnet means positioned between said first and second elements with opposite poles facing separate ones of the first and second elements so that a path for magnetic flux flow from the permanent magnet means includes the first and second elements and the air gap, and current conduction means, having substantially the same shape as said air gap, positioned therein.

35. An electromagnetic transducer as defined in claim 34 wherein:

the cross-sectional shape of said first and second elements, in the direction of magnetic flux flow, is substantially in the shape of a U with the first ends of the first and second elements forming the open end of the U and with the air gap located in the U shaped structure.

36. An electromagnetic transducer as defined in claim 34 wherein:

the cross-sectional area of said permanent magnet means, transverse the direction of magnetic flux flow, is substantially greater than the cross-sectional area of the air gap, transverse the direction of magnetic flux flow, thereby providing a magnetic flux concentration in said air gap.

37. An electromagnetic transducer as defined in claim 34 wherein:

at least one of said first and second elements have a tubular shaped extension at its second end thereof wherein the extension forms said air gap with said other of said first and second elements.

38. An electromagnetic transducer as defined in claim 34 including:

diaphragm means connected at its peripheral edge to said current conduction means.

39. An electromagnetic transducer comprising:

stator means including first and second tubular shaped open ended magnetic flux translative elements, the second element having smaller dimensions than the first element so that the second element is positioned in a substantially concentric relation within the second element, first and second tubular shaped pole pieces extending from said first and second elements, respectively, and adjacent one end thereof so that said first and second pole pieces define a tubular shaped air gap therebetween, and permanent magnet means mounted between said first and second elements with opposite poles facing separate ones of first and second elements so that magnetic flux flows from said permanent magnet means through a path including the first and second elements and said air gap, the cross-sectional area of the permanent magnet means, transverse the direction of magnetic flux flow, is substantially greater than the cross-sectional area of the air gap, transverse the direction of magnetic flux flow, and current conduction means, having substantially the same tubular shape as said air gap, movably mounted in said air gap.

40. An electromagnetic transducer as defined in claim 39 including:

diaphragm means connected along it peripheral edge to said current conduction means.

41. An electromagnetic transducer as defined in claim 40 wherein:

said first and second elements, said first and second pole pieces, said air gap, and said current conduction means have a serpentine tubular shape.

* * * * *